United States Patent [19]

Daly et al.

[11] Patent Number: 5,073,127

[45] Date of Patent: Dec. 17, 1991

[54] STRAIN RELIEF ASSEMBLY FOR FLAT CABLE CONNECTOR

[75] Inventors: John K. Daly, Scottsdale; Earl R. Kreinberg, Phoenix; Marty E. Adcock, Scottsdale, all of Ariz.

[73] Assignee: AMP Incorporated, Harrisburg, Pa.

[21] Appl. No.: 649,092

[22] Filed: Jan. 31, 1991

Related U.S. Application Data

[62] Division of Ser. No. 511,662, Apr. 20, 1990, Pat. No. 5,007,858.

[51] Int. Cl.[5] ..... H01R 13/533; H01R 13/595

[52] U.S. Cl. ..... 439/473; 439/701

[58] Field of Search ..... 439/460, 468–473, 439/701

[56] References Cited

U.S. PATENT DOCUMENTS

| | | | |
|---|---|---|---|
| 3,054,081 | 9/1962 | Bertram et al. | 439/472 |
| 4,169,648 | 10/1979 | Moist, Jr. | 439/467 |
| 4,632,495 | 12/1986 | Furman | 439/660 |
| 4,764,130 | 8/1988 | DiClemente | 439/701 |
| 4,781,615 | 11/1988 | Davis et al. | 439/395 |
| 4,859,204 | 8/1989 | Daly et al. | 439/424 |
| 4,887,976 | 12/1989 | Bennett et al. | 439/492 |
| 4,915,650 | 4/1990 | Daly et al. | 439/498 |
| 4,921,442 | 5/1990 | Puerner | 439/499 |

OTHER PUBLICATIONS

IBM Bulletin, Martin, vol. 3, No. 6, p. 2, 11-1960, copy in 439/472.

AMP Catalog 73-162, "ARINC 404 Rack and Panel Connectors", pp. 1-11 and 18-22, Revised 2-90, AMP Inc., Harrisburg, PA.

*Primary Examiner*—Neil Abrams

*Attorney, Agent, or Firm*—Anton P. Ness

[57] ABSTRACT

An electrical connector assembly includes a metal shell and a plurality of dielectric housings each housing a terminated end of each of a pair of flat cables of the type for transmission of electrical power at substantial current and voltage levels. Each mating terminal pair includes at least one having a contact section having an array of spring arm contact sections deflected by portions of the other when mated. Each termination is proximate a portion of a shell for heat dissipation. One of the shells is adapted for mounting to a bulkhead at a cutout, and the connectors are environmentally sealed to be appropriate for bulkhead mounting. Each connector includes a strain relief assembly suitable for use with flat cables of substantial rigidity and defines a cable exit, all after said terminated cables and housings thereabout are assembled into the shell. A jackscrew system is used for facilitating connector mating.

6 Claims, 9 Drawing Sheets

STRAIN RELIEF ASSEMBLY FOR FLAT CABLE CONNECTOR

This application is a divisional of application Ser. No. 07/511,662 filed Apr. 20, 1990, now U.S. Pat. No. 5,007,858.

FIELD OF THE INVENTION

The present invention is related to the field of electrical connectors and more particularly to connectors for flat power cable.

BACKGROUND OF THE INVENTION

U.S. Pat. No. 4,915,650 discloses terminating a flat power cable having one (or two side-by-side) flat conductors with a pair of terminals crimped onto a slotted end thereof by penetrating the insulation covering the cable's conductor and also shearing through the conductor (or conductors) at a plurality of locations. The cable is of the type entering commercial use for transmitting electrical power of for example between 50 and 100 amperes nominal; the single conductor flat cable includes a flat conductor one inch wide and about 0.020 inches thick with an extruded insulated coating of about 0.004 to 0.008 inches thick over each surface with the cable having a total thickness of up to about 0.034 inches. Such terminals can also be used to terminate flat cable having two spaced flat conductors each 0.45 inches wide separated by a narrow median of dielectric material, instead of the cable having a single conductor. Each terminal has a pair of opposed plate sections transversely across each of which are termination regions containing an array of shearing wave shapes alternating with relief recesses, so that when the pair of plate sections disposed against major surfaces of the flat cable at an end thereof are pressed together and against the cable therebetween, the arrays of shearing wave shapes cooperate to shear the conductor of the flat cable into a plurality of strips which remain integral with the cable. The wave shapes also deflect the newly sheared conductor strips into the opposing relief recesses so that newly sheared conductor edges are moved adjacent electrical engagement surfaces defined by the vertical side edges of the adjacent shearing wave shapes forming electrical connections of the adapter terminals with the flat cable conductors.

The pair of plate sections of each terminal both extend forwardly from a rearward cable-receiving terminal end where they coextend forwardly at a slight angle from a pair of bight sections spaced laterally apart defining a cable-receiving slot therebetween. Tab-shaped portions are blanked on the end section of the cable and are inserted through the cable-receiving slots of the terminals to be disposed between upper and lower plate sections of each terminal. The upper and lower plate sections of each pair are pressed together, being rotated about the bight sections which act as integral hinges, so that the shearing wave shapes shear and deflect strips of the conductor (or conductors) of the cable forming a termination of the terminals to the cable; alternatively, the wave shapes can deflect previously sheared conductor strips of appropriate width into opposing relief recesses.

The method of terminating is preferably as described in U.S. Pat. No. 4,859,204, and preferably the terminals are two-part assemblies of adapter members including the cable-adjacent terminal portions and the contact sections, and low resistance copper members fastened to the outwardly facing surface of each of the adapter members at their respective terminating regions. The inserts have terminal-facing surfaces conforming closely to the shape of the outer surface of the terminating region, with alternating wave shapes and apertures disposed outwardly of and along the adapter member's shearing wave shapes and relief recesses. Upon termination the wave joints are within the insert apertures, and the sheared edges of the adjacent conductor strips and of the terminal wave shapes which formed the sheared strips are adjacent to side walls of the copper insert apertures. A two-step staking process is disclosed: in a first step the wave joints are split axially so that portions of each of the arcuate shapes defining the relief recesses of both plate sections of the adapter member are forced inwardly against the adjacent sheared conductor strip of the respective wave joint to define spring fingers whose ends pin the conductor strip against the opposing wave crest to store energy in the joint; and in the second step a staking process deforms the insert between the sheared strips to deform the copper against the sheared conductor and wave shape edges, forming gas-tight, heat and vibration resistant electrical connections with the cable conductor and with the terminal, so that the inserts are electrically in series at a plurality of locations between the conductor and the adapter.

A contact section is integrally included on the adapter member of such terminal assemblies enabling separable mating with corresponding contact means of an electrical connector and can include a plurality of contact sections to distribute the power to a corresponding plurality of contact means if desired or to define a plurality of electrical paths to a single corresponding contact means. One such contact section is disclosed in U.S. Pat. No. 4,887,976. A housing or other dielectric covering can be placed around the termination as desired.

It is desired to provide a mating connector assembly for one or more such electrical flat power cable terminations which is appropriate for transmission of electrical power from one or more flat power cables to other such cables or other power transmission means, or to an electrical device or apparatus such as a computer.

It is additionally desired that such a connector assembly effectively dissipate heat generated by the electrical interconnections transmitting substantial current levels within the assembly.

It is also desired that such a connector assembly be provided with environmental sealing across the mating connector interface and thereby be appropriate for power transmission through a bulkhead or panel.

It is further desired that each connector of the assembly include strain relief means to protect the terminations, and also to provide for the cable or cables to exit the connectors at a right angle to be disposed along a surface of the bulkhead or panel remote from the connectors.

It is additionally desired to provide dielectric housings surrounding the terminations and to provide a rugged, durable metal shell around the housed terminations for physical protection and also for EMI shielding, which is mountable to the bulkhead or panel.

Further, it is desirable that the connector assemblies be suitable for housing electrical interconnections for the transmission of electrical power at substantial current levels as well as at substantial voltage levels for long-term in-service use.

SUMMARY OF THE INVENTION

The mating connector assembly of the present invention includes a pair of connectors defined by metal shells within which are secured one or more dielectric housings containing terminals terminated to end sections of respective flat power cables, either single conductor or dual conductor. One of the metal shells is a receptacle shell and may be adapted for mounting to a bulkhead, and the other is a plug shell matable with the receptacle shell and includes a sealing member therearound for sealing the mating interface from the environment at the shell interface periphery. The dielectric housings are also matable and in one connector are plug housings and in the other are receptacle housings. The contact sections of the terminals of both connectors are recessed within forward sections of both types of housings and are also matable to define assured electrical connections at the mating interface when the connectors are fully mated. Strain relief members are secured to the rearward faces of the conectors which include means for clamping tightly against the flat cables as they exit the connectors; the strain releief assemblies each preferably direct the cables around a right angle bend pirior to exiting the connectors, to extend along the bulkhead surface outside the connectors.

Each connector includes a strain relief assembly mounted along the rearward shell face and having an inner member disposed vertically between the cable pairs on one side of the connector and the cable pairs on the other, and respective outer members secured to the inner member along both sides and to the shell. Each outer member includes cable passageways for each pair of flat cables, a center wall dividing the upper and lower passageways, and the passageways extending around a right angle curve. The center wall extends below the cable exits of each outer member to define a support section, and cable clamping members are secured tightly to lateral flanges of the support section clamping each pair of cables to respective side surfaces of the support, and preferably the cable clamping members include an elastomeric cable-engaging portion to be deformed tightly against the outwardly facing surface of the support-remote one of each cable of the cable pair to provide an environmental seal along the cable exits of the strain relief assembly of each connector. The strain relief assembly thus covers the entire rearward face of the metal shell of each connector at least rearwardly of the housings. The inner member of the strain relief assembly can be appropriately apertured to be inserted over the actuation shaft of a jackscrew extending rearwardly from one of the connectors, and also over other conductor wires extending rearwardly from the connectors disposed between the upper and lower cable pairs of each side, which may be desired for use in electronically detecting a fully mated connector condition or remote sensing of voltage levels, such as using conventional pin and socket contacts matable along the mating face; seal members within the metal shell provide sealing about the jackscrew shaft and the conductors for the sensing terminals. The connector assembly is also capable of disassembly for repair or replacement of parts.

It is an objective of the present invention to provide a connector assembly suitable for electrical interconnection of flat power cables for the transmission of electrical power at substantial levels of current and voltage.

It is also an objective to provide such a connector mountable to a bulkhead for mating at a bulkhead cutout for electrical power transmission from one side of a bulkhead to the other.

It is another objective for the assembly of such connectors to accommodate a plurality of flat power cables, each cable capable of transmitting power up to at least 270 volts and up to at least 100 amperes, for example, and provide for the dissipation of heat generated by their interconnected terminations and also be resistant to temperatures commonly associated with power connections.

It is also another objective for such a connector to provide for strain relief for the plurality of flat power cables, and to provide for the plurality of cables to exit the connector at a right angle.

It is yet another objective for such a connector to receive the cables in closely spaced associated pairs and to maintain the terminations thereof in associated pairs to tend to reduce susceptibility to EMI transmission along the cables through the connector assembly.

It is further an objective for such a connector to provide at least for environmental sealing at the bulkhead cutout.

It is additionally an objective to provide such a connector to have a compact arrangement with a mating interface of minimized dimensions.

An embodiment of the electrical connector assembly of the present invention will now be described with reference to the accompanying drawings.

DETAILED DESCRIPTION OF THE PREFERRED EMBODIMENT

Figure 1:
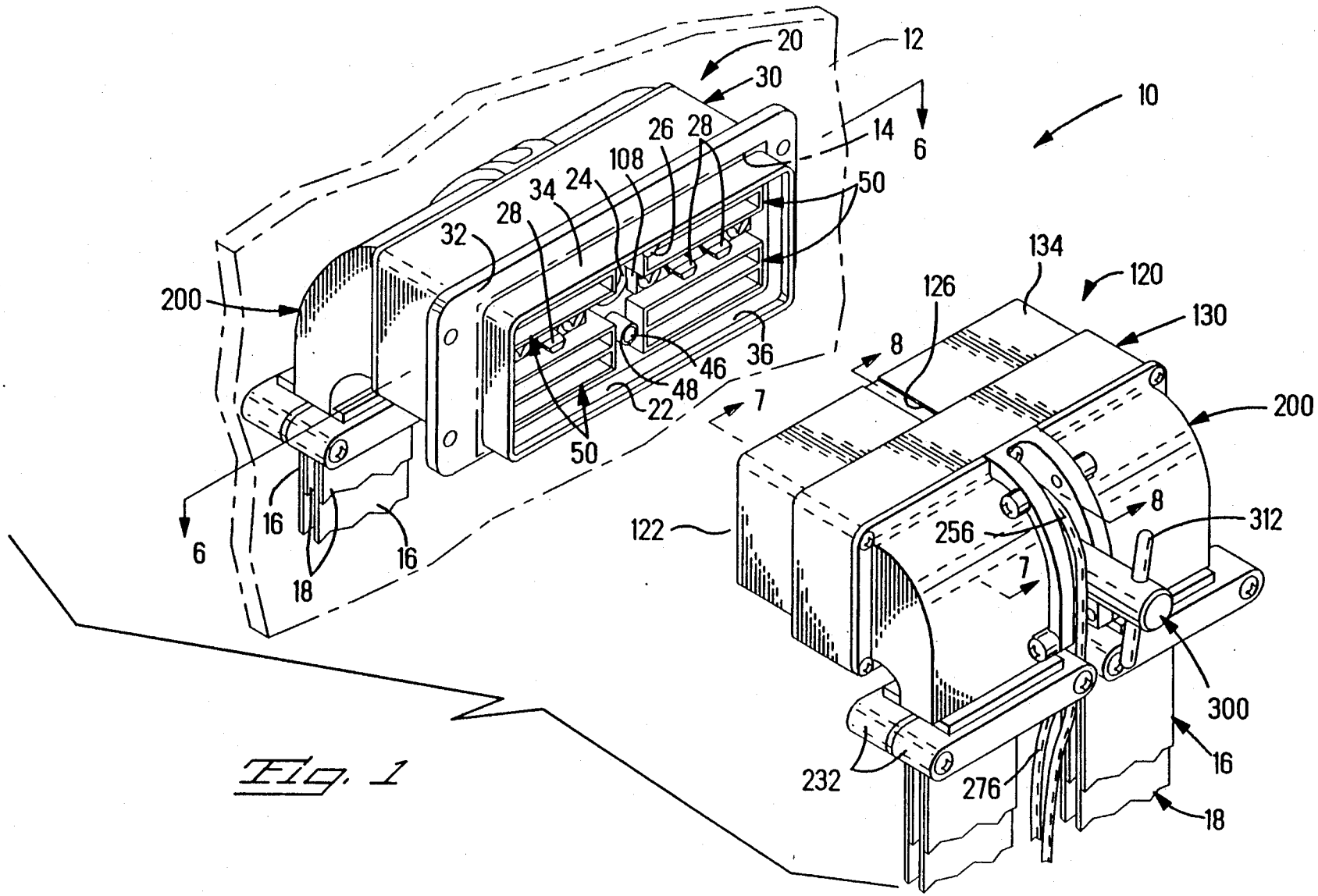
FIG. 1 is an isometric view of a pair of plug and receptacle connectors of the present invention matable at a bulkhead cutout.

FIG. 1 illustrates an electrical connector assembly 10 of the present invention having a receptacle connector assembly 20 mounted to a bulkhead 12 at a cutout 14 therethrough (shown in phantom), and a plug connector assembly 120 matable with receptacle connector 20. Connectors 20,120 are assembled onto an array of flat power cables associated in pairs of upper 16 and lower 18 cables. Upper cables 16 for example can transmit electrical power at 100 amperes and 270 volts from a power source such as a power supply to an apparatus such as a computer (not shown) while lower cables 18 can comprise the return circuit therefor, with the cables being of the single conductor type. Pairing the source and return paths together in adjacent flat cables can reduce EMI susceptibility and reduce pair impedance, and flat cables are desirable for providing substantial surface area to facilitate dissipation of heat generated by high amperage power transmission. Connector assemblies 20,120 comprise receptacle and plug metal shells 30,130 in which are mounted four receptacle and plug housing assemblies within which are secured terminals all of which are adapted to be matable together, with forward sections of receptacle housing assemblies 50 seen along mating face 22 of connector 20. Metal shells 30,130 may be formed of machined cast aluminum for example having good heat transfer properties, and have respective transverse body portions of substantial bulk through which extend the plurality of cavities and apertures between a front face and a rearward face thereof.

Plug connector 120 is shown having a jackscrew 300 centrally therethrough having a threaded forward end 306 (FIG. 3) receivable into a corresponding aperture 24 of receptacle connector 20 when the connectors are axially aligned and moved substantially together, so that actuation of jackscrew 300 by rotation of the actuator 312 at the rearward end can draw the connectors fully together in an even, precisely aligned axial manner overcoming the substantial resistance to mating generated by the mating of the plurality of contacts adapted to electrically engage with substantial contact normal force. Receptacle connector 20 also includes a polarizing key 26 receivable along polarizing keyway 126 of plug connector 120, to assure appropriate relative orientation of the connectors prior to mating. The connectors also are provided with a keying arrangement for physically encoding the particular plug and receptacle connectors to be mated together to preclude mating of other identically appearing but noncorresponding connectors; receptacle connector 20 is shown including three key members 28 selectively oriented which will permit mating in cooperation with correspondingly oriented key members of the plug connector (see FIGS. 3 and 4), together providing 216 keying combinations when the keys are hexagonal.

Figure 2:
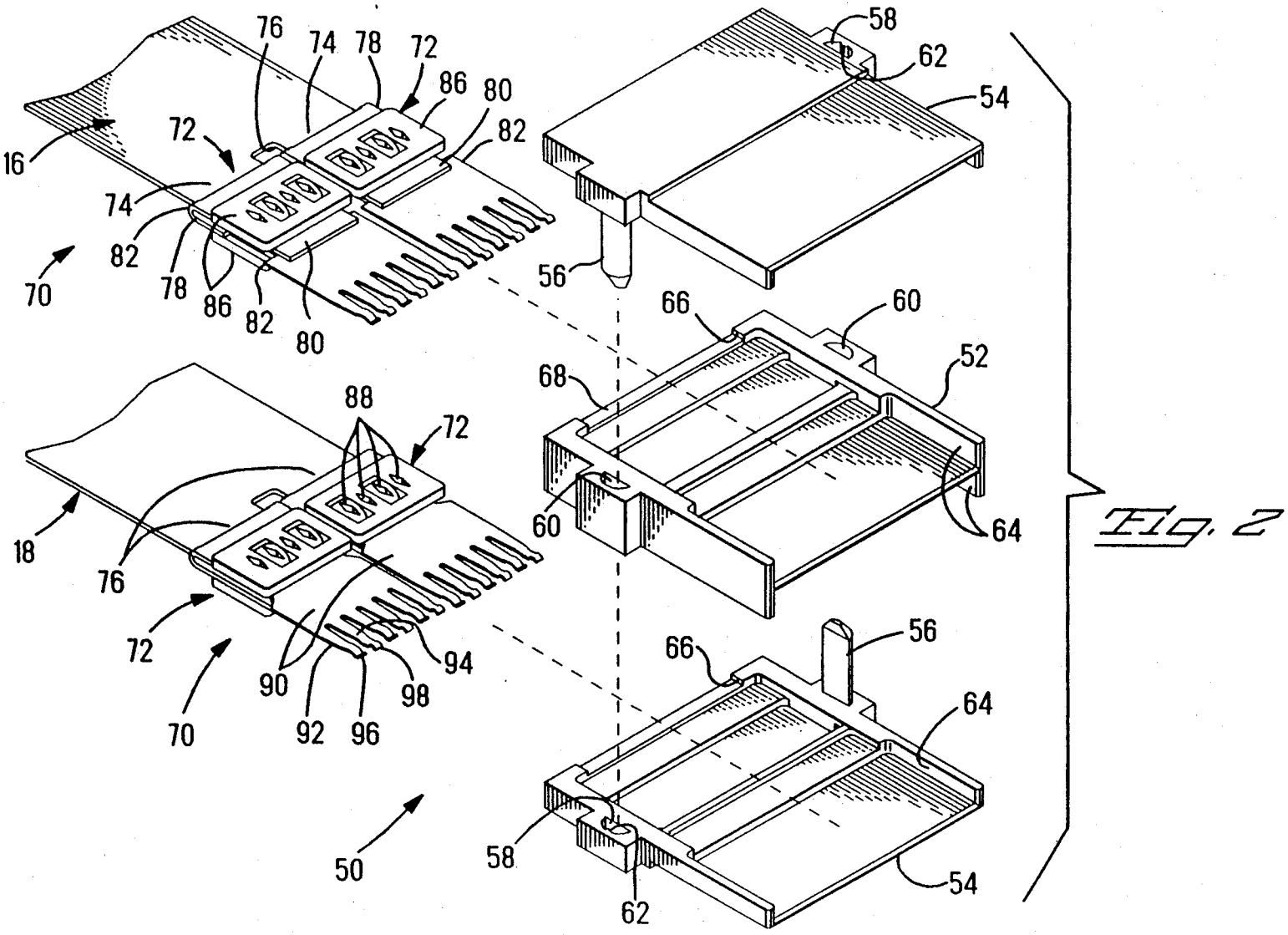
FIG. 2 is an exploded isometric view of a receptacle housing assembly for a pair of terminated flat power cables, to be retained in the metal shell of the receptacle connector of FIG. 1.

A housing assembly 50 of receptacle connector 20 is illustrated in FIG. 2 along with a pair of terminated flat power cables 16,18. The cable terminations 70 preferably are of the type disclosed in U.S. Pat. No. 4,915,650 and comprise a pair of spaced apart terminal assemblies 72 crimped onto respective tab sections 74 of the cable end defined by slot 76 blanked onto the end of the cable. Each terminal assembly 72 includes an adapter member 78 having an upper plate section 80 and a lower plate section 82 extending forwardly from a rearward bight section 84 defining an integral hinge; the hinge includes a tab-receiving slot thereacross (not shown) through which a cable tab section 74 extends to be disposed between the upper and lower plate sections. Each terminal assembly 72 further includes an insert member 86 along the outer surface of each plate section at the termination region. Indentations 88 are visible which result from the staking method disclosed in U.S. Pat. No. 4,859,204. Insert members 86 may preferably of the type disclosed in U.S. Pat. No. 4,975,080 which interlock to each other upon staking for an assured mechanical joint enhancing the maintenance of an assured electrical connection especially resistant to vibration and many cycles of heating and cooling. Contact sections 90 extend forwardly from one of the upper and lower plate sections 80,82 to conclude in arrays of six alternating first and second spring contact arms 92,94 having arcuate free ends 96,98 alternatingly adapted to be deflected upwardly or downwardly respectively upon mating. Adapter members 78 may be formed of beryllium copper, Alloy No. 17410, half HT temper for example, and insert members 86 formed of Copper CDA 110, with terminals 72 being silver plated and tarnish resistant coated.

Figure 3:
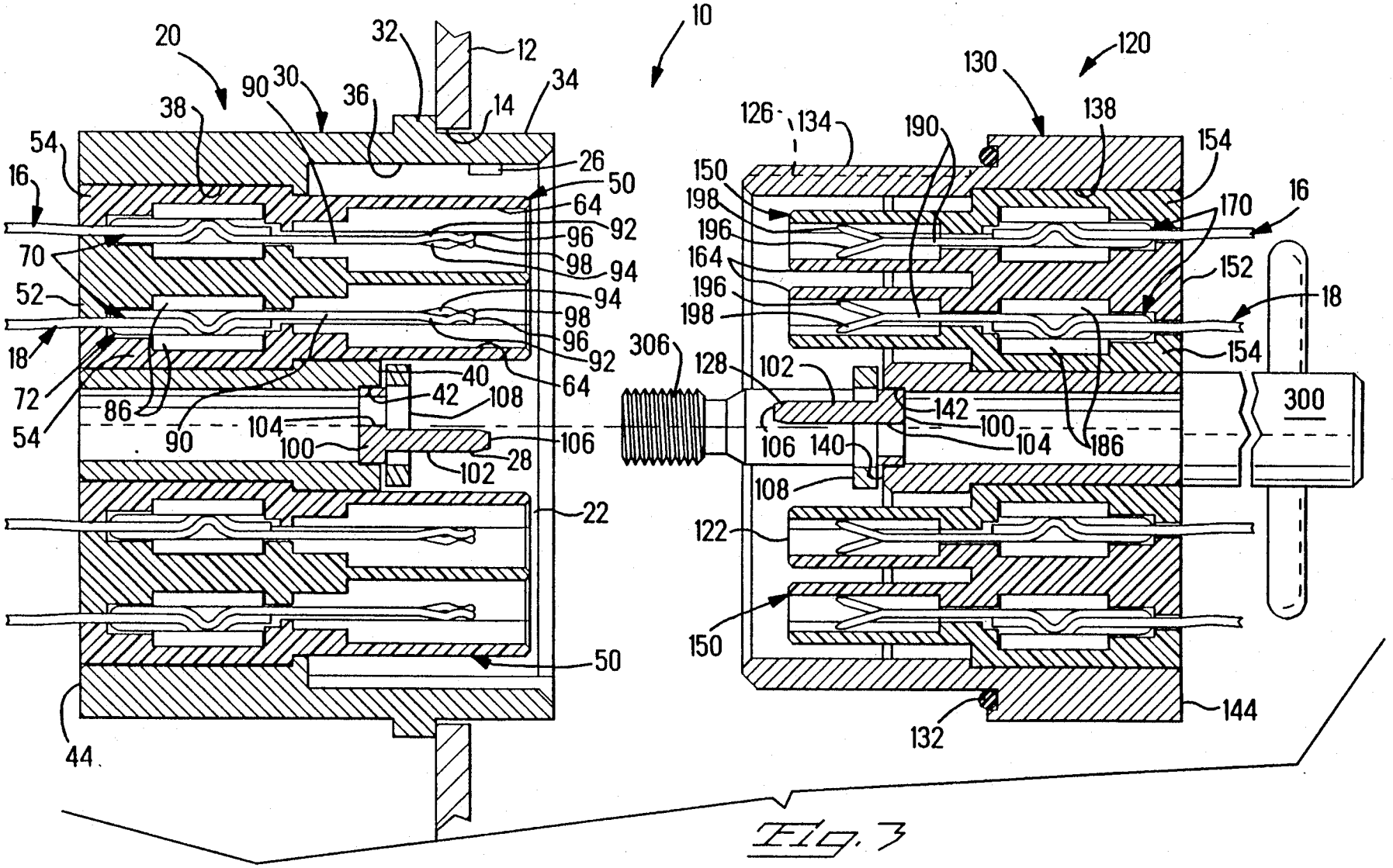
FIG. 3 is an elevation section view showing upper and lower plug and receptacle housing assemblies and mating terminal contact sections therein of both connectors aligned to be mated at a bulkhead cutout, and also showing corresponding key members for keying the connectors.
Figure 4:
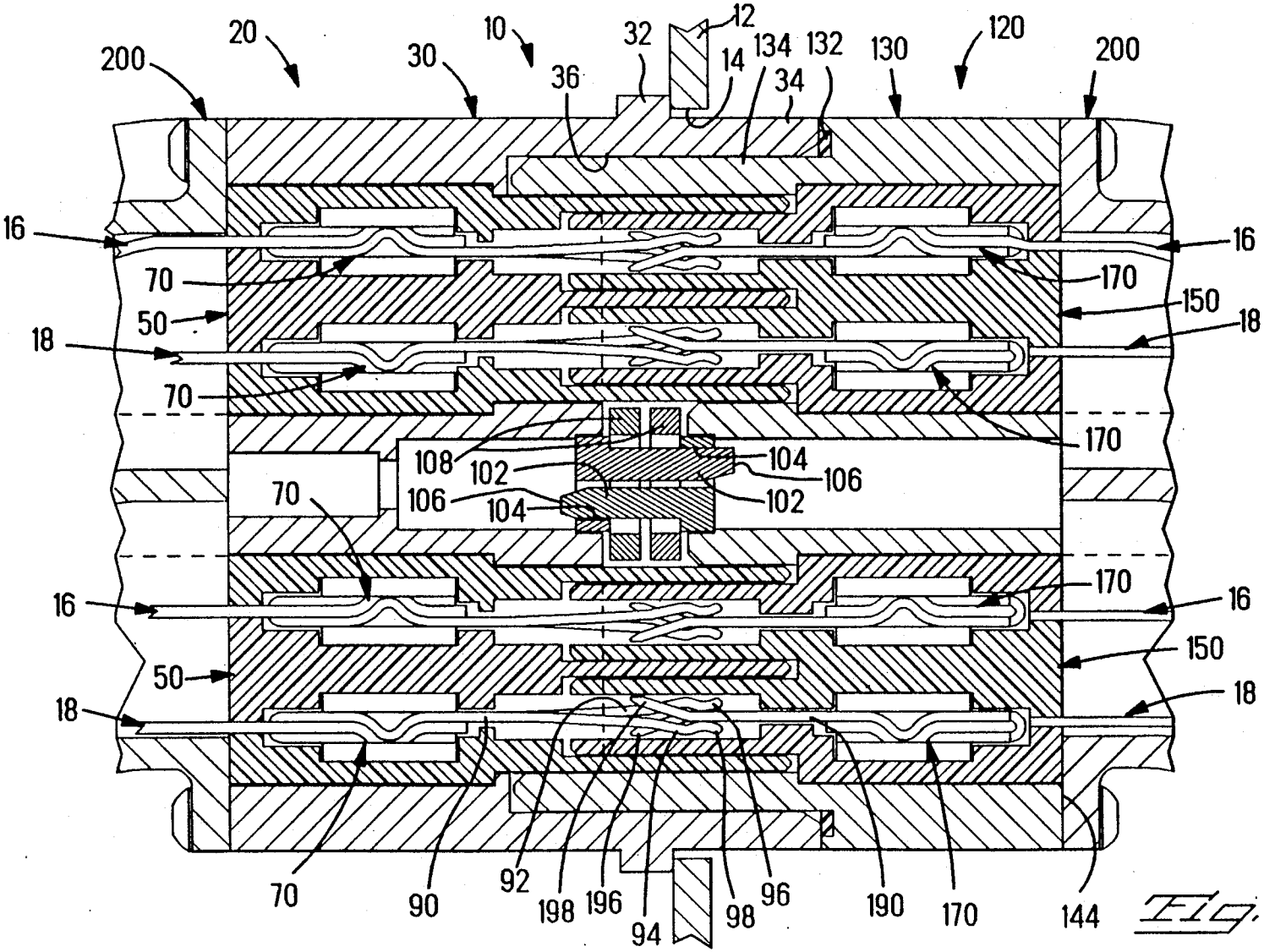
FIG. 4 is a view of the connectors of FIG. 3 after mating.

Each housing assembly 50 is preferred to receive and house terminations 70 of two flat cables 16,18 as a pair insulated from each other. A common inner housing member 52 is disposed between the pair of terminations 70, and two hermaphroditic outer members 54,54 are securable to inner member 52 along outwardly facing surfaces of the terminations. Inner and outer housing members 52,54,54 may be molded of polyacetate or polyester resin, for example, or may be of ceramic material having good heat transfer properties. One means of securing the inner and outer covers together is similar to that disclosed in U.S. Pat. No. 4,781,615; each outer cover includes a semicylindrical leg 56 along one side and a corresponding leg-receiving semicylindrical aperture 58 along the other side, with the sides of inner member 52 having two leg-receiving apertures 60 therethrough. Thus leg 56 of each outer cover 54 extends through an aperture 60 of inner member 52 and into aperture 58 of the other outer cover member 54; a rib 62 along the side of leg-receiving aperture 58 is plastically deformed upon receipt of a leg 56 force-fit thereinto thus defining a mechanical joint sufficient to maintain the housing covers assembled together until being placed within metal shell 30. Upon assembly, the covers define a pair of large cavities 64 within which the arrays of contact arms 92,94 are disposed. In a receptacle housing assembly 50 each cavity 64 is large enough to receive thereinto a plug portion of a mating plug housing assembly, as seen in FIGS. 3 and 4. Each plug housing assembly is similar to receptacle housing assembly 50 except in that its forward end defines a pair of plug portions receivable into the pair of cavities 64 of the receptacle housing assemblies 50. Cables 16,18 extend rearwardly from narrow channels 66 between the inner and two outer covers 52,54,54 through rearward end 68 of housing assembly 50, and terminations 70 are disposed in front of forwardly facing ledges at rearward end 68.

Figure 6:
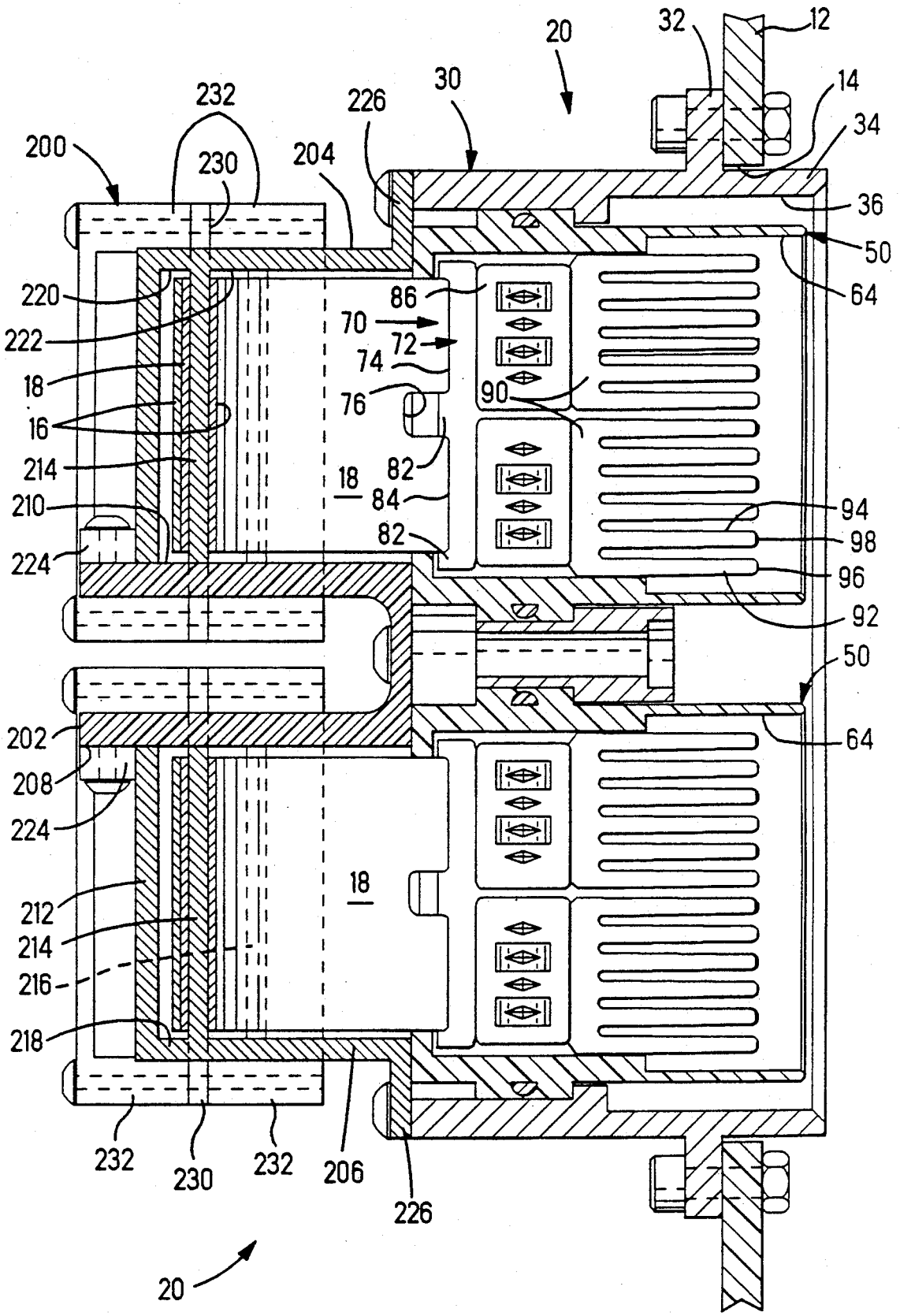
FIG. 6 is a plan section view of the receptacle connector of FIG. 1 taken along lines 6—6 thereof.
Figure 7:
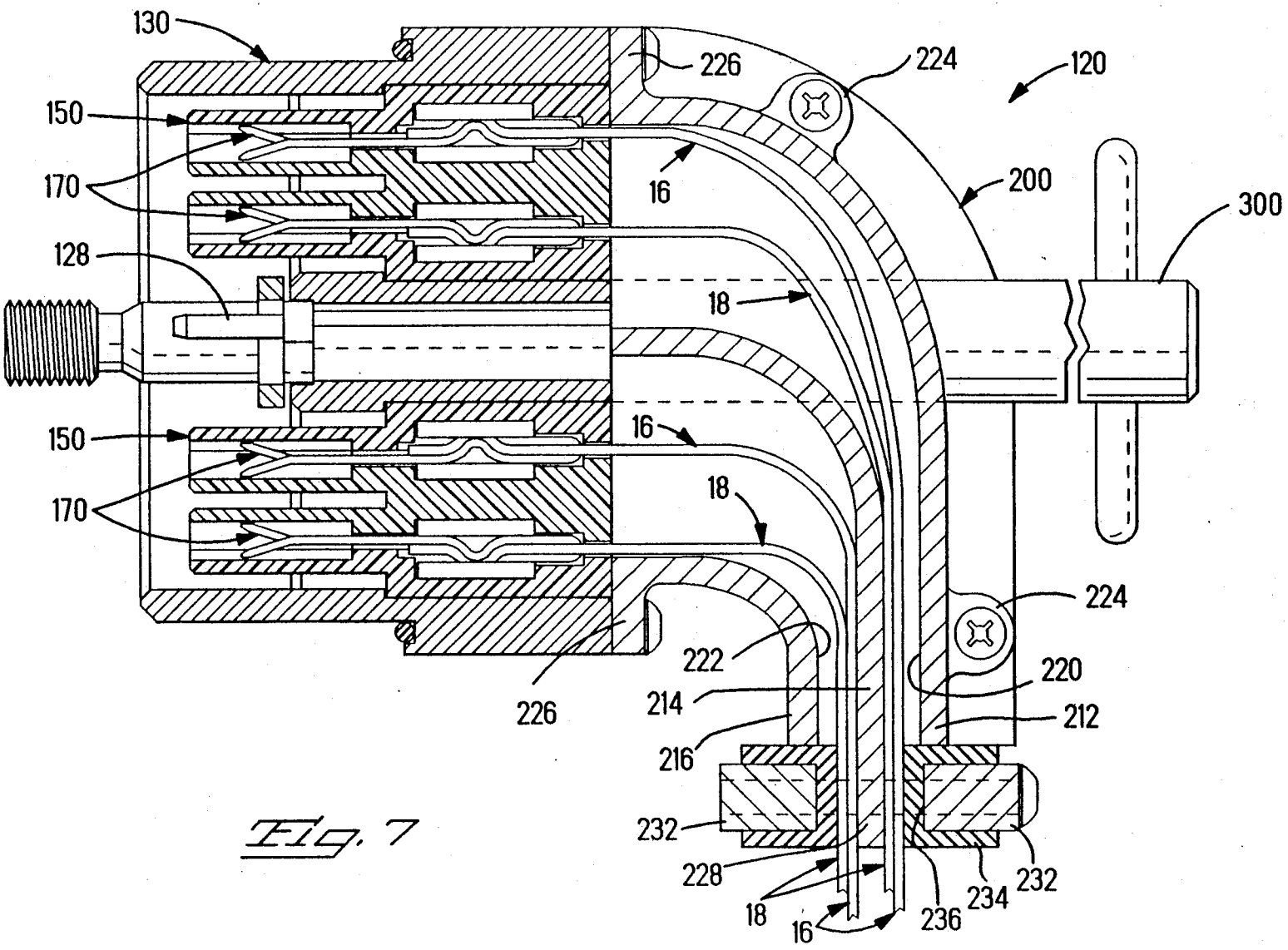
FIG. 7 is an elevation section view of the plug connector of FIG. 1 taken along lines 7—7 thereof illustrating the strain relief assembly and cable exit.

In FIG. 3, receptacle connector 20 has been mounted in cutout 14 of bulkhead 12 by means of fasteners through mounting flange 32 (FIGS. 1 and 6) with a hood section 34 of metal shell 30 extending therethrough, defining a receptacle cavity 36. Upper and lower housings 50 are seen disposed in respective passageways 38 in shell 30 defined between upper and lower wall sections having substantial horizontal area and behind rearwardly facing ledges of passageways 38, and contain a pair of terminations 70 of the pair of cables 16,18, with contact sections 90 having first and second spring contact arms 92,94 extending forwardly within cavities 64 of housing assemblies 50 to respective free ends 96,98 for mating. Housing assemblies 50 may be secured in shell member 30 such as by strain relief assembly 200, or by a plate member (not shown) secured across rearward shell face 44. Forward portions of housing assemblies 50 are recessed behind the leading edge of hood section 34 of shell 30 and thus are protected thereby. Plug connector 120 is aligned for mating with receptacle connector 20 and metal shell 130 thereof includes a plug section 134 adapted to be receivable in a close fit into receptacle cavity 36 of receptacle shell 30, and further includes an elastomeric ring 132 at the base of plug section for sealing environmentally against the leading edge of receptacle hood section 34 upon full mating. Upper and lower housing assemblies 150 are disposed in cavities 138 and include forward plug sections 164 receivable into cavities 64 of receptacle housing assemblies 50 upon mating. Forward plug sections 164 of housings 150 ar recessed behind the leading edge of plug section 134 of shell 130 and thus are protected thereby.

Upon assembly the housings completely enclose the terminations as is appropriate for transmission of power at substantial voltage levels; the contact sections are exposed along the mating face of the housings but are recessed behind the leading end thereof. The forward portions of the housings are recessed behind leading edges of the hood section or plug section of the respective shell member, and thus are physically protected by the shell members upon connector mating. When the housed terminations are inserted into respective shell cavities, along one major side of each termination is a passageway wall section defining a major surface portion of the body of a shell member adjacent the housing's outer surface, the proximity of bulk metal to the termination establishing a good mechanism for dissipation of heat generated in the termination and the separable mating interface of the mating contact sections, with a wall of limited thickness defined by the outer cover member of the housing assembly.

With reference to FIG. 3, terminations 170 within plug housing assemblies 150 are identical to terminations 70 of receptacle housing assemblies 50 except for contact sections 190, which are matable with contact sections 90 of terminations 70. The terminals for use in terminations 170 have adapter members of Copper Alloy 100-1052, H02 temper for example, and have insert members 186 identical to insert members 86; the terminals are also identically silver plated and tarnish resistant coated. Each contact section 190 includes an array of first and second rigid ramped blade sections alternatingly arranged and having ramped first and second forward end sections 196,198 angled downwardly and upwardly respectively to correspond with first and second spring contact arms 92,94 of contact sections 90 and are thereby adapted to deflect arcuate free ends 96,98 upwardly and downwardly respectively. The ramped nature of the blade sections easily initiates spring arm deflection without requiring the arcuate spring arm free ends to extend for a substantial length at an angle from the mating axis to initiate deflection, resulting in a minimized deflected height across the mated connection as described in U.S. Pat. No. 4,887,976.

FIG. 3 also illustrates a pair of hermaphroditic keys 28,128 matchingly oriented to matchingly key or physically encode the particular plug and receptacle connectors to permit mating thereof. Each key has a hexagonal body section 100 forwardly from which extends a keying projection 102 comprising half of a hexagon in cross-section, and body section 100 also includes a key-receiving aperture 104 profiled to define the other half of the hexagon in cross-section to receive thereinto the mating keying projection. With the keys matchingly oriented, leading ends 106,106 thereof will pass by each other and eventually enter the key-receiving aperture 104 of the mating key; if the connectors are not matchingly keyed the leading ends 106,106 will abut and prevent the connectors from being moved further together, to prevent mating of plug and receptacle connectors not intended to be matable. Keys 28,128 are secured into receptacle and plug shells 30,130 by apertured plates 108 (FIG. 1) which are fastened to front faces 40,140 of shells 30,130 after key body sections 100 are placed and oriented appropriately in respective hexagonal openings 42,142 into the respective shell body.

The plug and receptacle connectors 20,120 are shown in fully mated condition in FIG. 4. Keying projections 102 have passed by each other and entered the corresponding key-receiving aperture 104. Plug section 134 of plug shell 130 has been received into receptacle cavity 36 formed by hood 34 and in a close fit therewith, passing by upper and lower receptacle housing assemblies 50. Plug sections 164 of plug housing assemblies 150 have been received into respective cavities 64 of receptacle housing assemblies 50. First and second ramped blade sections 196,198 of contact sections 190 of terminations 170 have deflected corresponding first and second spring contact arms 92,94 of contact sections 90 of terminations 70 outwardly in the appropriate direction, and spring arm free ends 96,98 are spring biased with substantial normal force against surfaces of contact sections 190 of terminations 170 to establish assured electrical engagement between mated terminals for power transmission. The mated terminals provide a plurality of assured electrical connections and electrically connect flat power cables 16,18 of the receptacle connector 20 with corresponding flat power cables 16,18 of the plug connector 120, by means of a plurality of discrete electrical paths, which minimizes electrical resistance and consequent generation of heat. If desired, the contact sections of one of the mating terminals can be formed and/or assembled in such a way as to extend forwardly of the others to provide early electrical connection during the mating sequence, such as the terminals on the return cables electrically engaging first during mating and breaking last during unmating.

Figure 5:
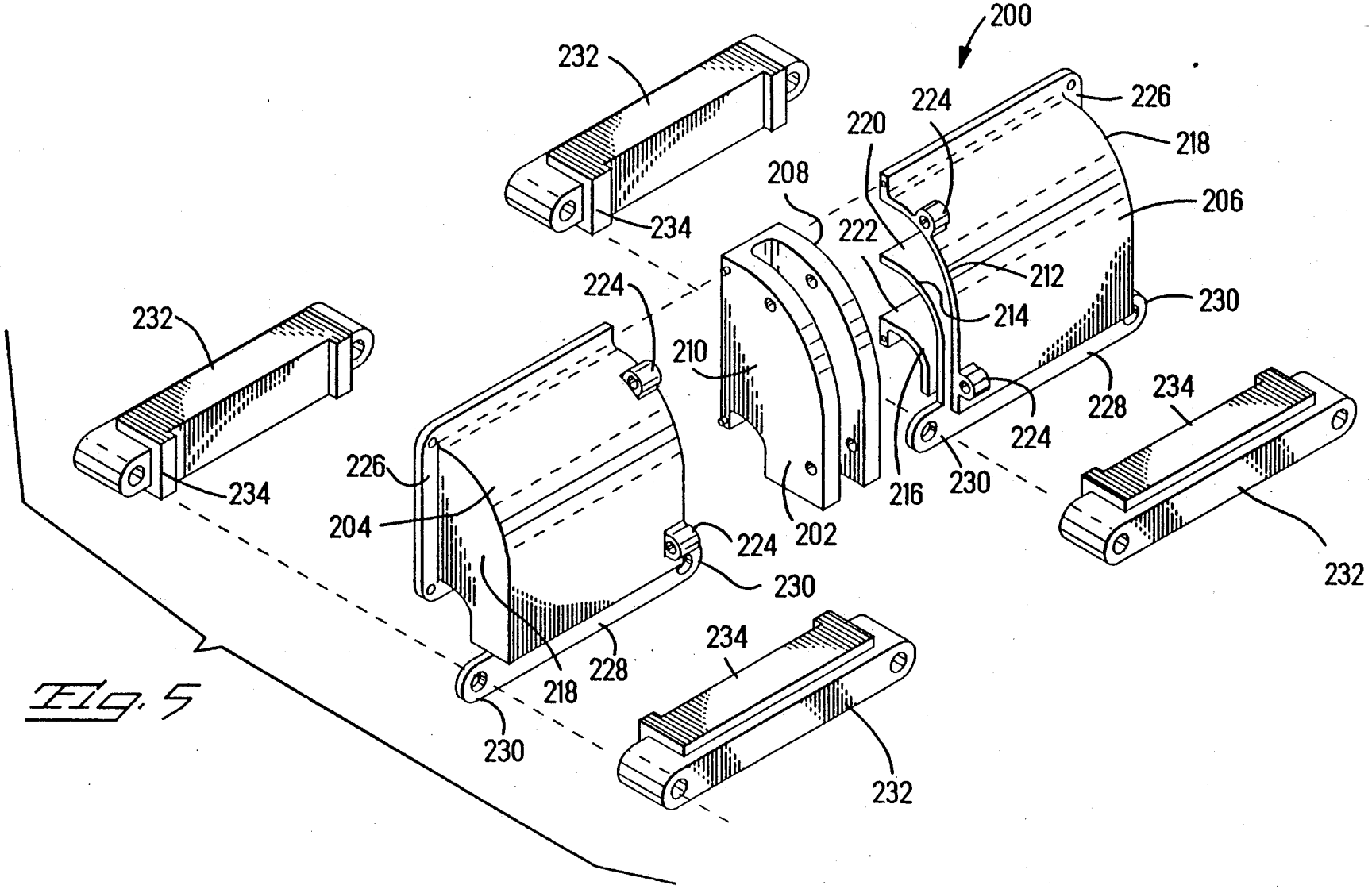
FIG. 5 is an exploded isometric view of the strain relief assembly of one of the connectors of FIG. 1.

FIGS. 5 through 8 show a strain relief assembly securable to the rearward face of receptacle and plug connectors 20,120 to provide assured strain relief for flat power cables 16,18 and also to provide environmental sealing of the rearward face of the connectors. In FIG. 5 each strain relief assembly 200 includes an inner member 202 and a pair of outer members 204,206. Inner and outer members 202,204,206 can be of cast aluminum, for example. Inner member 202 extends vertically between the pairs of flat cables 16,18 on each side of each connector, and is mounted to rearward face 44 of receptacle shell 30 or to rearward face 144 of plug shell 130. Subsequently, each outer member 204,206 is mounted to a respective side 208,210 of inner member 202 and also to rearward face 44 or 144. Each outer member 204,206 includes three lateral wall sections 212,214,216 which coextend laterally inwardly from an outer or end wall section 218 to respective end edges spaced from each other to define three sides of gently arcuate upper and lower cable passageways 220,222 within which upper and lower pairs of flat cables 16,18 are disposed to eventually exit the respective connector at a right angle to the terminations and the mating axis, and to extend along the vertical surface of the bulkhead. The fourth side of each passageway 220,222 is formed by the respective side 208,210 of inner member 202 after each outer member 204,206 is placed over the two pairs of cables 16,18 from laterally thereof by receiving lateral edges of the respective cables between the spaced apart end edges of lateral walls 212,214,216. In the embodiment shown, outer members 204,206 are then fastened to inner member 202 at flanges 224 and to peripheral portions of rearward shell face 44,144 along mounting flanges 226 about the periphery of the forward portions of outer members 204,206. Altogether, strain relief assembly 200 closed off or covers the rearward face of the shell of the connector which is otherwise open for insertion of the terminated and housed cable ends into the respective cavities of the shell.

Center wall 214 between passageways 220,222 extends beyond and below the ends of the passageways to provide a support section 228 having laterally extending flanges 230 to which a pair of cable clamps 232 are fastened by a pair of bolts along either side of the pairs of cables 16,18 along the forward and rearward surfaces of support section 228. Each cable clamp 232 includes elastomeric material 234 along the cable-proximate surfaces 236 thereof to be adjacent the cable surfaces and be deformingly clamped thereagainst when cable clamps 232 are fastened tightly to support section 228, and to tightly clamp the cable pairs against support section 228 thus forming an environmental seal closing the cable exits of passageways 220,222. Cable clamps 232 can be of stainless steel for example and the elastomeric material 234 can be silicone rubber bonded onto the steel portion.

Figure 8:
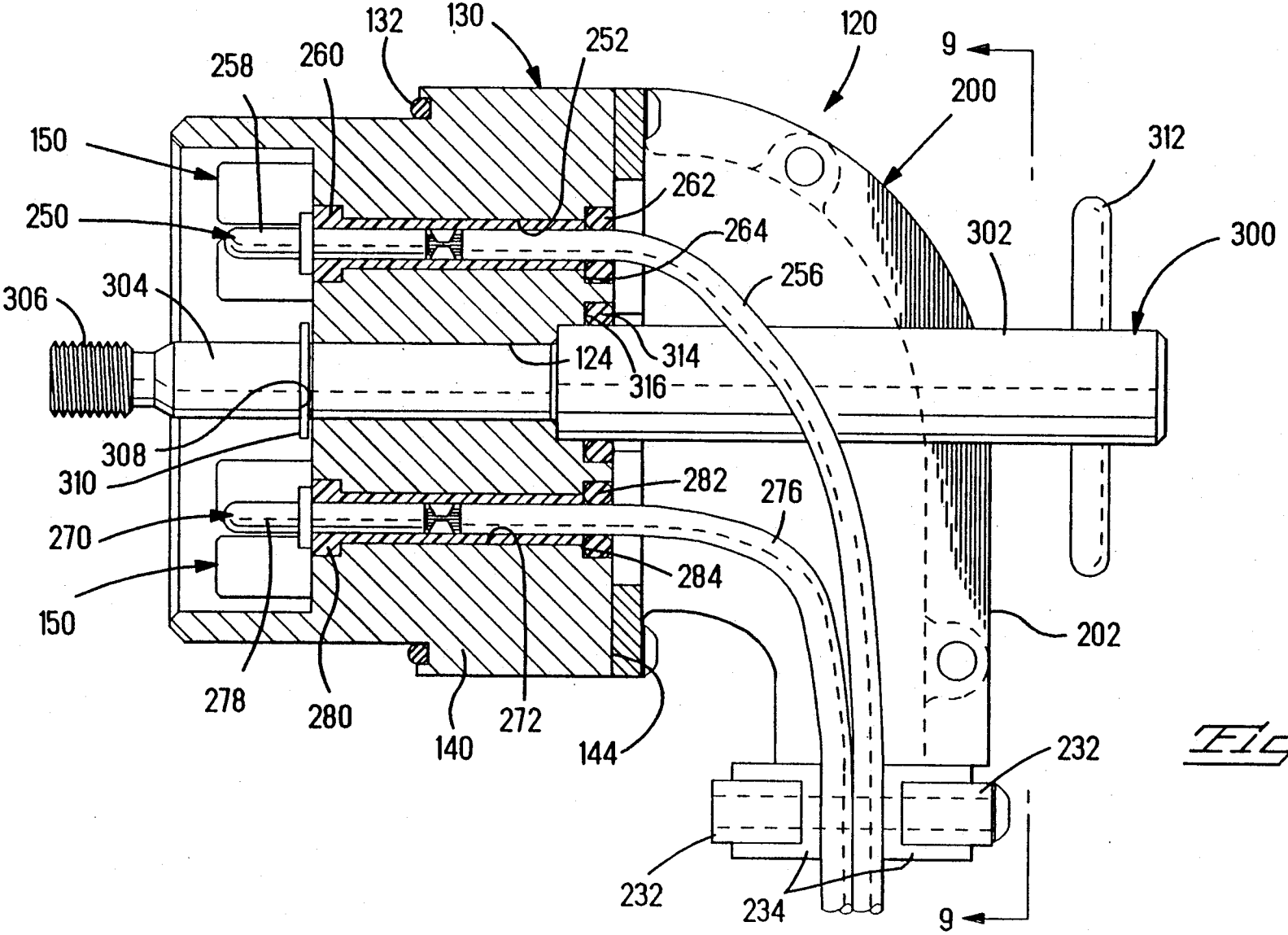
FIG. 8 is an elevation section view of the plug connector of FIG. taken along lines 8—8 thereof illustrating the jackscrew and additional conventional terminals terminated to conductor wires of a sensing circuit extending through the center wall of the connector.

Referring to FIGS. 1 and 8, plug connector 120 includes jackscrew 300 and also optionally includes a pair of additional terminals 250,270 situated above and below jackscrew shank 302 and within respective apertures 252,272 through plug shell 130. Terminals 250,270 can be terminated onto conductor wires 256,276 to comprise a circuit for electronically sensing a fully mated connector condition when mating is achieved or for remotely sensing voltage levels, with a corresponding terminal (FIG. 1) of receptacle connector 20. Each terminal 250,270 can be mounted within an insulative bushing 260,280 of dielectric material such as plastic secured in passageway 252,272 and can include a pin contact section 258,278 extending forwardly of mating face 122 of connector 120 to be received in a corresponding socket terminal 46 within a silo portion 48 of the associated insulative bushing extending forwardly of mating face 22 of connector 20, as seen in FIG. 1. O-rings 262,282 such as of silicone rubber are preferably disposed around conductors 256,276 along rearward face 144 of plug shell 130. O-rings 262,282 are held in respective recesses 264,284 along the rearward shell face by inner strain relief member 202.

Jackscrew 300 includes a large diameter rearward shank portion 302 rearward of plug shell 130 and a smaller diametric forward shank portion 304 concluding in a threaded forward en 306. An annular recess 308 just forwardly of shell body 140 enables a C-clip 310 or similar means to be clipped around forward shank portion 304 to secure jackscrew 300 in plug shell 130 in a manner permitting rotation thereof in aperture 124. A large O-ring 314 is disposed around rearward shank portion 302 within rearward portion or recess 316 of aperture 124 for sealing therearound. Cross piece 312 through the rearward end of jackscrew 300 serves as an actuator for rotating jackscrew 300. As can be seen in FIG. 8, as jackscrew 300 would be rotated the bearing surface defined at the forward end of the rearward shank portion abuts the surface of recess 316 to incrementally urge shell 130 toward connector 20 during the final stages of connector mating.

Figure 9:
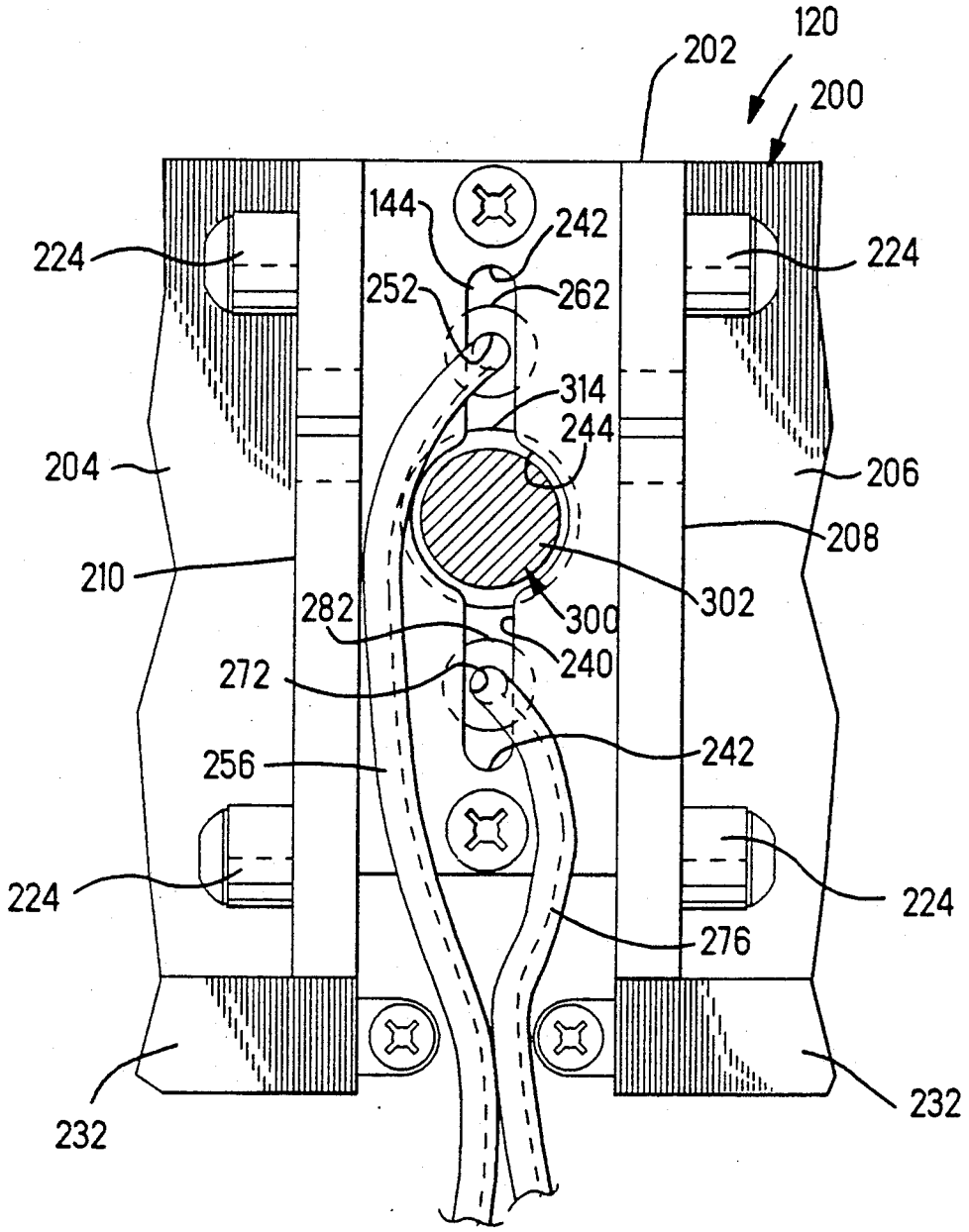
FIG. 9 is an elevation partial rear view of the plug connector of FIG. 1 showing the central connector portion.

Referring to FIG. 9, inner strain relief member 202 includes a profiled elongated slot 240 to enable being placed over cross piece 312 of jackscrew 300 during assembly. End sections 242 of slot 240 extend over the axes of passageways 252,272 and enable conductors 256,276 to extend rearwardly from shell 130. The width of end sections 242 is small enough to hold O-rings 262,282 of slightly larger diameter underneath the periphery of slot 240 and within recesses 264,284. The enlarged center portion 244 of slot 240 is large enough to enable jackscrew shank 302 to be rotated freely therewithin but small enough to hold large O-ring 314 in recess 316. For strain relief assembly 200 for receptacle connector 20, an elastomeric plate member may be used to completely cover enlarged portion 244 of slot 240 in inner member 202, to close off rearward face 44 of receptacle connector 20.

Altogether connector assembly 10 provides an appropriate connector for an array of flat power cables transmitting power levels of electrical current therethrough, with substantial strain relief for protecting the terminations housed within the connectors. The connectors also receive the cables in associated pairs and maintain the terminations of the cables in associated pairs to reduce the susceptibility to electromagnetic interference (EMI) capable of being conducted along the cables and into the ultimate electronic apparatus to which the power is being transmitted. Connector assembly 10 is environmentally sealed for use as a bulkhead connector, and is compact to enable the bulkhead cutout to be of minimum dimensions. The shell members 30,130 serve as effective heat dissipators for the connector making it suitable for power transmission at substantial current and voltage levels, and the connectors are well suited for use in high temperature environments where the temperatures can sometimes achieve up to 150° to 200° C. The terminations and contact sections are surrounded by dielectric material, appropriate for substantial voltage levels. The connector assembly includes a jackscrew for appropriate even aligned connector mating in a manner overcoming the substantial resistance to mating generated by the plurality of contact sections each adapted to mate with substantial contact normal force necessary in transmission of electrical power at substantial current and voltage levels. The connector assembly is easily unmated and each connector is also capable of disassembly for repair and replacement of parts.

Various modifications can be made to the connector of the disclosed embodiment of the present invention, such as to provide for more cables, or fewer, or for a mating interface having a different shaped outline, or provide for axial cable exit, or not be mounted to a bulkhead, all within the spirit of the invention and the scope of the claims.

What is claimed is:

1. A strain relief assembly for a connector used with a plurality of flat cables, each flat cable including at least one flat conductor of substantial width and incremental thickness, the connector being suitable for housing terminations of terminal means to respective ends of ones of the cable conductors for transmission of electrical power at substantial levels of current and voltage across a mating interface, at least two said flat cables extend rearwardly from a rearward face of a shell member of the connector, and the strain relief assembly being securable to the rearward shell face, said assembly comprising:

at least first and second members, each said first and second member including lateral walls joined to a common end wall of said member at a first side remote from the other of said first and second members and extending laterally from said common end wall to edges at an opposed second side such that said edges are spaced apart to receive lateral edges of at least a respective one of said flat cables therebetween extending form terminations thereof housed within said shell, said first and second members securable together upon being moved laterally relatively together from respective said lateral edges of said flat cables to define at least one cable passageway extending from forward portions of said first and second members adjacent said rearward shell face to a cable exit such that said at least two flat cables are surrounded by said first and second member until extending therefrom at said cable exit, and said at least first and second members including peripheral portions of said forward portions associated with peripheral portions of said rearward shell face surrounding said flat cables extending therefrom and adapted to fit thereagainst upon said first and second members being secured to said rearward shell face; and said strain relief assembly having a support section at said cable exit and including means for clamping said flat cables to said support section to protect said terminations of said terminal means to respective said flat cables from stress otherwise transmittable thereto by said flat cables, whereby said strain relief assembly is adapted to be securable along said rearward shell face behind rearward ends of said housed terminations after said terminations have been housed within said shell member and surround said plurality of flat cables extending from said rearward shell face, and be clamped to said flat cables, and said strain relief assembly defining a covering for said rearward shell face enabling said rearward shell face to include a plurality of openings for insertion of respective said terminated cable ends thereinto to be housed.

2. A strain relief assembly as set forth in claim 1 for a connector having dielectric means each housing two said terminations to two respective said flat cables, four said flat cables thereby extending rearwardly from said at least one upper and one lower housing-receiving cavities in said shell member, said strain relief assembly defining two said cable passageways along each of which two of said flat cables extend as a pair to respective said cable exits, and said strain relief assembly includes a support section extending therefrom between said cable exits, and said means clamping said flat cables are mounted to said support section clamping both said cable pairs thereto.

3. A strain relief assembly as set forth in claim 2 for a connector having a shell member including two said upper and said lower housing-receiving cavities spaced laterally apart, in which are disposed respective said dielectric means each housing respectively at least one said termination to a respective said flat cable, such that at least four said flat cables extend rearwardly from said shell member in two laterally spaced pairs, said strain relief assembly comprising an inner member extending vertically between said laterally spaced pairs of flat cables, and two outer members each securable to said inner member on respective sides thereof after being moved laterally theretowards over respective ones of said laterally spaced pairs of flat cables to enclose said cable pair within said strain relief assembly.

4. A strain relief assembly as set forth in claim 3 for a connector having dielectric means each housing two said terminations to two respective said flat cables, eight said flat cables thereby extending rearwardly from said shell member in two upper laterally spaced pairs and two lower laterally spaced pairs, said strain relief assembly defining upper and lower ones of said cable passageways along each side of said inner member along which a said upper and lower cable pair extends respectively to a respective said cable exit, and each said outer member includes a support section extending therefrom between said cable exits, and said means clamping said flat cables are mounted to each said support section clamping both said cable pairs thereto.

5. A strain relief assembly as set forth in claim 2 wherein said cable passageways extend around a right angle from said rearward shell face to said cable exits, whereby said cables exit said connector at a right angle.

6. A strain relief assembly as set forth in claim 5 for a connector including a jackscrew extending through a central vertical wall of said shell member and includes a rearward shank extending rearwardly from said rearward face of said shell member to an actuation end, said inner strain relief member including an aperture through which said rearward jackscrew shank extends.

* * * * *